US008882302B2

(12) United States Patent
Avila

(10) Patent No.: US 8,882,302 B2
(45) Date of Patent: Nov. 11, 2014

(54) COINED OPTIC FIXTURE FOR LED ILLUMINATION

(76) Inventor: Henry Avila, Palmdale, CA (US)

( * ) Notice: Subject to any disclaimer, the term of this patent is extended or adjusted under 35 U.S.C. 154(b) by 620 days.

(21) Appl. No.: 12/837,214

(22) Filed: Jul. 15, 2010

(65) Prior Publication Data

US 2012/0014107 A1 Jan. 19, 2012

(51) Int. Cl.

| | |
|---|---|
| ***F21V 29/00*** | (2006.01) |
| ***F21V 7/04*** | (2006.01) |
| *F21S 4/00* | (2006.01) |
| *F21V 7/20* | (2006.01) |
| *F21Y 101/02* | (2006.01) |
| *F21V 7/06* | (2006.01) |

(52) U.S. Cl.

CPC ..... *F21V 29/2237* (2013.01); *F21V 7/048* (2013.01); *F21S 4/008* (2013.01); *F21V 7/20* (2013.01); *F21Y 2101/02* (2013.01); *F21V 7/06* (2013.01)

USPC ..... 362/294

(58) Field of Classification Search

None

See application file for complete search history.

(56) References Cited

U.S. PATENT DOCUMENTS

| | | | | |
|---|---|---|---|---|
| 4,799,136 | A * | 1/1989 | Molnar | 362/300 |
| 4,964,025 | A * | 10/1990 | Smith | 362/346 |
| 5,723,868 | A * | 3/1998 | Hammond et al. | 250/553 |
| 6,547,416 | B2 * | 4/2003 | Pashley et al. | 362/231 |
| 6,644,841 | B2 * | 11/2003 | Martineau | 362/545 |
| 7,300,185 | B1 * | 11/2007 | Ruffin et al. | 362/347 |
| 7,943,946 | B2 * | 5/2011 | Ito | 257/98 |
| 2002/0080622 | A1 * | 6/2002 | Pashley et al. | 362/555 |
| 2007/0001177 | A1 * | 1/2007 | Bruning et al. | 257/79 |
| 2008/0204888 | A1 * | 8/2008 | Kan et al. | 359/629 |

* cited by examiner

*Primary Examiner* — Britt D Hanley

(74) *Attorney, Agent, or Firm* — Gordon & Rees LLP

(57) ABSTRACT

An optic for use with LED illumination sources, incorporates multiple facets in rows along its length. The facets are formed by coining (cold forming) the shapes into a suitable malleable material. By selecting the malleable material to have high heat conductivity and mounting the optic in contact with the circuit board that drives the LED, the optic serves both light dispersion and heat sink functions. Since the facets are formed with high precision they can be selected to direct light to an illuminated surface (actual or virtual). The use of multiple facet shapes (e.g. linear, radius and parabolic) the light can be reflected (multiple times if desired) to provide a highly selectable illuminated field. In the most common installation the different facets are used to uniformly illuminate a surface.

18 Claims, 7 Drawing Sheets

Steps In Selecting And Aiming Facets For Uniform Illumination Fig 3

1) Identify the target area

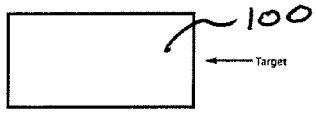

(Fig. 3A)
front view

2) Determine the desired placement of the light source

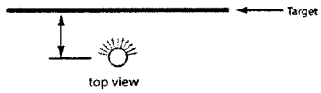

top view
(Fig. 3B)

3) Find the max horizontal angle needed to illuminate the target in the horizontal dimension.

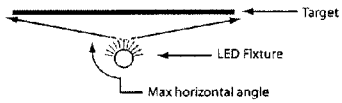

(Fig 3C)

4) Find the max vertical angles necessary to illuminate the target in the vertical dimension.

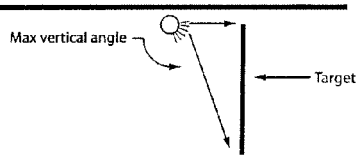

(Fig 3D)

5) Orient the coined optic horizontal facets (linear, radius, or parabolic) to reflect the light rays created by the emitter to target the horizontal angles found in the target area (Fig 3a)

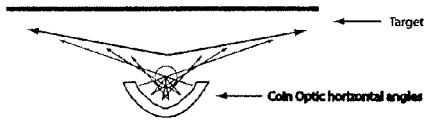

(Fig. 3E)

6) Orient the coined optic vertical facets (linear, radius, and parabolic) to reflect the light rays created by the emitter to target the vertical angles found in the target area (Fig. 3a)

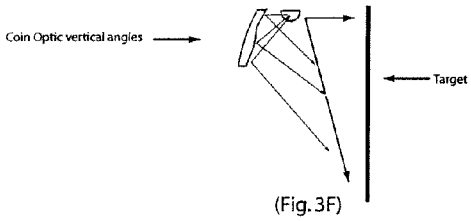

(Fig. 3F)

The facet height and with can increase or decrease to direct the amount of light needed in any focused area any combination can be used linear, radius, or parabolic or as many vertical or horizontal facets to create a high efficient and uniform distribution. Coining facets from aluminum and other metals is the most accurate and cost effective method today.

COINED OPTIC FIXTURE FOR LED ILLUMINATION

BACKGROUND OF THE DISCLOSURE

Various prior art techniques have been developed to attempt to produce a uniform or other desired illumination pattern on an illuminated surface. For example, reflective sheet metal then bent to a desired shape have been designed to be incorporated into an optic using one or more LED's. The term optic is intended to include conventional reflectors and refractive optical elements as well as focusing/defocusing lenses. These optics are typically relatively thin (e.g. 1/32 inch or less) so that it is easily bent to the final form. Acrylic plastic (formed and molded) has also been used. However these optics at present cannot be formed with adequate optical precision to reflect or direct light accurately to a selected location on a surface. These optics can therefore have efficiencies of less than 50%. Part of the problem with prior art designs when applied to a LED emitter are that they do not account for the characteristics of LED's which are virtually a point source of light and therefore magnify the effect of low precision optics.

Prior art optics have not provided direct conduction of heat form the LED through the optic. The LED is positioned on a circuit board and therefore heats the circuit board that drives the LED and can cause early failure from overheated components or require an over sized heat sink on the rear of the circuit board for heat dissipation.

The use of LED's for illumination (as opposed to the display of a condition) has rapidly evolved, however there has not been a solution to the problem of using LED's to achieve uniform illumination over a specified area.

All LED's use a relatively small amount of power and generate a relatively small amount of heat. A single LED is nearly a point source of light and can be installed in a fixture using a conventional parabolic reflector (as in a flashlight) to produce a highly focused beam. LED's have also been utilized for room accent lighting, such as recessed can lights or track lights. This use of LED's in those applications has been limited to circumstances where an even distribution of light is not essential. Multiple LED's have been utilized in the same fixture, using the same reflector to "aim" the LED light into spot beams in such a way as to create a wider illuminated area, however the areas between spot beams are not uniformly illuminated so that LED's have been limited to those applications where uniformity of illumination is not an issue.

A common lighting requirement is in display cases and art illumination. These two applications are often referred to as display lighting. Presently display lighting applications are met by fluorescent tubes and elongated incandescent bulbs using a single filament and mounted in a fixture with an elongated reflector. Because the illumination emanates from an elongated source and assuming an illumination area that has a length no greater than the length of the bulb or tube, the illumination from these fixtures is the best that can be achieved with current technology. In these applications a cylindrical reflector produces poor illumination uniformity over a fairly narrow angular range and highly inefficient light flux and uses lighting technology that generates substantial heat.

The problems of the inefficiency of incandescent lighting and the somewhat better efficiency but lower quality of light (narrow spectrum and glare) from fluorescent lights are well known but no one has devised a way to satisfy the requirements of display lighting with any known technology. LED lights are efficient in generating light (good lumens) and produce relatively little heat but because they are a near point light source they have been thought to be impractical for display lighting and other applications were wide dispersion of light is required. As used herein "near point source" should be taken to mean a source of light that emanates from an source of illumination that is very small as compared to the dimension of the fixture that directs the light.

SUMMARY OF THE INVENTION

The invention is based on the realization that unexpected benefits can be achieved from cold forming facets into metal with close tolerances to make a highly efficient optic with potential for wide angle dispersion, when desired, of near point source light. An optic according to the invention also has the ability to produce an illumination pattern on a surface that, when desired, produces a highly uniform illuminated surface, and highly efficient generation of light flux. These benefits are applicable to LED and other near point sources of illumination. They can be achieved in an optic that can also serve as a heat sink to draw heat away from the light source and associated circuit board and thereby maintain a lower operating temperature.

The invention was developed with the realization that a combination of high light production efficiency inherent in LED's with highly efficient (high reflection), accurately surfaced facets could produce a fixture that would redirect a higher percentage of the light from the LED point source, over a more uniform field than any known technology. Such a fixture could potentially be useful in display lighting and similar applications. Commonly used techniques for producing faceted fixtures cannot produce facets of sufficient accuracy to achieve the requisite illumination uniformity or conformation to explicit non-uniform requirement. The deficiencies in current technology facets make them an unlikely choice for display technology using LED emitters because the light emanates from a near point source which magnifies the errors in the reflected light ray to an unacceptable degree.

An LED emits light when a small voltage (typically under 4 volts) and current (typically under 1 amp) passes though and anode and cathode of the emitter. The emitter is contained within a transparent envelope and mounted on a circuit board. The LED chip is protected by a silicon lens, the chip is put in place by a bond layer and coated with a phosphor layer that sits on a ceramic substrate. The LED and other components on the circuit board generate heat that while small in comparison with other technologies can still shorten the life and reduce the efficiency unless the heat is rapidly dissipated.

The invention achieves highly accurate facet placement and angulation by cold forming (coining) metal to produce linear, radius or parabolic surfaces from flat stock. The flat stock is first stamped to create a series of flat patterns then a series of pre forms mimicking the exact shape of the final optics but without the facets and then finally the facets are pressed or coined in place all in one progressive tool. Cold forming in this manner is normally referred to as coining because the same process is used to stamp out coins. The invention was conceived with the recognition that cold forming could be effective to produce very accurate facets that maintain their shape and angulation integrity even after forming. In the instant embodiment the coined surfaces are then vacuum metalized or bight dipped to achieve a highly efficient reflective surface.

Other applications may require scattering or absorption over at least part of the reflective surface, these surfaces can be used in combination with the coined portion of the fixture to produce a hybrid fixture.

An unexpected benefit of using coined metal fixtures is the cost to produce. The cost is a fraction of most common method used today which is a molded plastic optic. Plastic optic costs can vary from fifty cents to one dollar when small to medium runs are made. The cost of a coined optic is less than ten cents when small to medium runs are made. Metal optics are much better heat conductors than plastic. Any optic is in close proximity to the emitter. The additional advantage of metal over plastic is that a metal optic, properly positioned in heat conductive relationship to the light source, makes it possible to turn the optic itself into a heat sink. Coined optics according to the invention are made from malleable metals such as aluminum, brass or copper. These metals are good heat conductors and have good heat dissipation characteristics. Using the optic as a sole or supplemental heat sink allows for the overall size of the fixture to be made as small as possible.

A feature of the invention is that multiple facet shapes can be used together to achieve the desired result. Linear (flat) facets control the extent to which the light emanating from the emitter is spread. Radiused facets are used to disburse the light to fill in areas that would otherwise receive insufficient light to produce a uniform light distribution. Parabolic sections are used to target specific areas that otherwise would be noticeably darker by utilizing the collimation properties of the parabolic sections to produce a narrow beam.

The use of facets of multiple types and with optimum positioning of the facets makes possible the customization of the illuminated field. The illuminated field is sometimes referred to herein as the illuminated surface or virtual surface. This terminology is utilized because the illuminated surface is not part of the fixture of the invention. Near flat surfaces (such as in a jewelry case) are sometimes present, whereas a very uneven surface may be present as in a food case. In either case the virtual surface may be considered flat and that surface that can be uniformly illuminated by the selection, positioning and angulation of the facets. A manufacturer can produce optics with a faceted fixture optimized for the widest possible uniform light distribution from a fixture that is close to the object to be illuminated and cause the light to be constrained to a particular shape of the illuminated field. For example, a single LED fixture can be mounted as close at 4 inches from a painting and illuminate the entire surface of a painting as large or larger than 3 feet wide by 5 feet high. It is estimated that the light level from a single LED drawing 10 watts, is as great as a typical incandescent fixture with a cylindrical reflector using 75 watts or more.

Another feature of the invention is that the metal from which the reflector is formed can be selected to be highly heat conductive. Coining requires the use of malleable materials which include such high heat conductive metals such as copper, aluminum or brass. The metal coined optic is then mounted directly on top of the circuit board to conduct heat away from the circuit board and provide for dissipation of the heat generated by the emitter. In this way the maximum heat flux is conducted away from the circuit board by the fixture and disbursed by radiation or convection to the ambient air. The circuit board may desirably also have a heat sink secured to the rear surface of the board to provide a large surface to radiate the heat from the LED. Heat dissipation that is optimized by using both rear mounted heat sinks and a front-mounted, high heat-conductive coned optic results in brighter illumination and longer LED life. The cooler the LED is kept, the greater the efficiency rises and the more the average life of the LED is increased.

BRIEF DESCRIPTION OF THE DRAWINGS

FIG. 3 shows the steps in the development of a coined optic with customized characteristics for a selected illumination application.

DETAILED DESCRIPTION OF THE DRAWINGS

Figure 1:
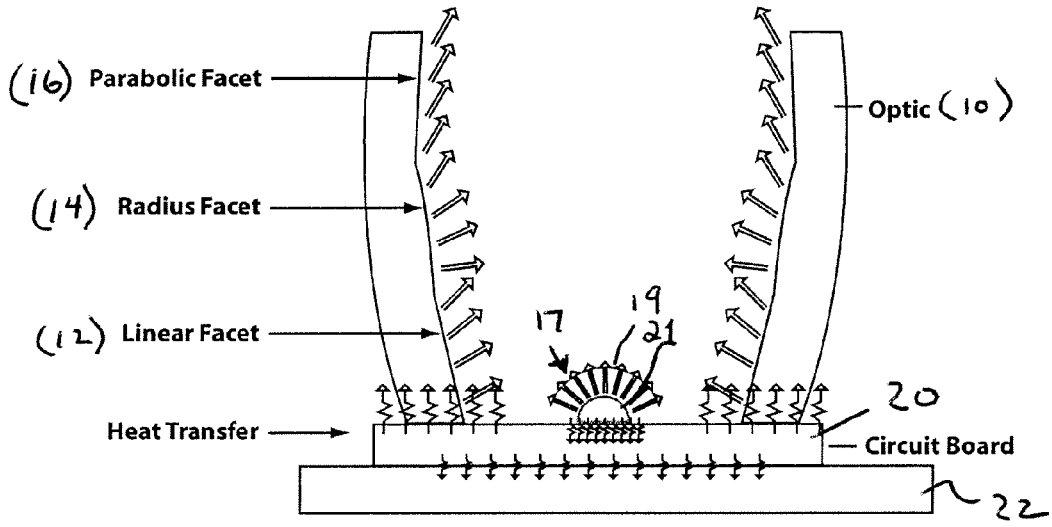
FIG. 1 is a sectional view of the coined optic fixture showing the light reflecting properties of three different facet types.

FIG. 1 shows a diagrammatic cross-section of a coined optic 10 showing three types of facets, linear 12, radiused 14, and parabolic 16. The optic is referred to as coined because, in the exemplary embodiment the facets are cold formed in malleable materials to a high accuracy. Since cold forming is utilized to stamp currency coins the process is generally known as coining. The representation of light rays which are reflected by each facet type are shown. As will appear, the rays from the innermost facets, in this case linear facets 12, may be reflected multiple times before be emitted from the optic. This multiple reflection results in the widest possible angulation of light relative to the central axis of the optic to illuminate the furthest corners of a designated area to be lighted.

In FIG. 1, the emitter is shown to be a near point source of light. In the exemplary embodiment the emitter is a light emitting diode (LED) 18, and the LED is mounted on a printed circuit board (PC) 20. The PC board delivers excitation voltage and current to the emitter. The PC board itself is in heat conductive contact with a heat sink 22. The function of a heat sink is to draw heat away from the heat producing components on the PC board including the LED itself and other power consuming, and therefore heat producing, components such as power conversion components used to convert AC to DC for example. While it is conventional to use a heat sink in conjunction with a printed circuit board, the ways in which the present invention maximizes heat transfer and therefore minimizes the operating temperature of the LED represents new technology and is partially responsible for the increased efficiency in creating a light flux of a desired value. The optic itself is mounted directly on the PC board. In preferred form the optic 10 is made from malleable metal with a high heat transfer efficiency. By mounting the optic in intimate contact with the PC board much of the heat generated by the components on the board are conducted away from the board and into the optic. Because the optic is free standing and can be surrounded by ambient air it can dissipate the heat by conduction, convection and radiation.

Figure 2:
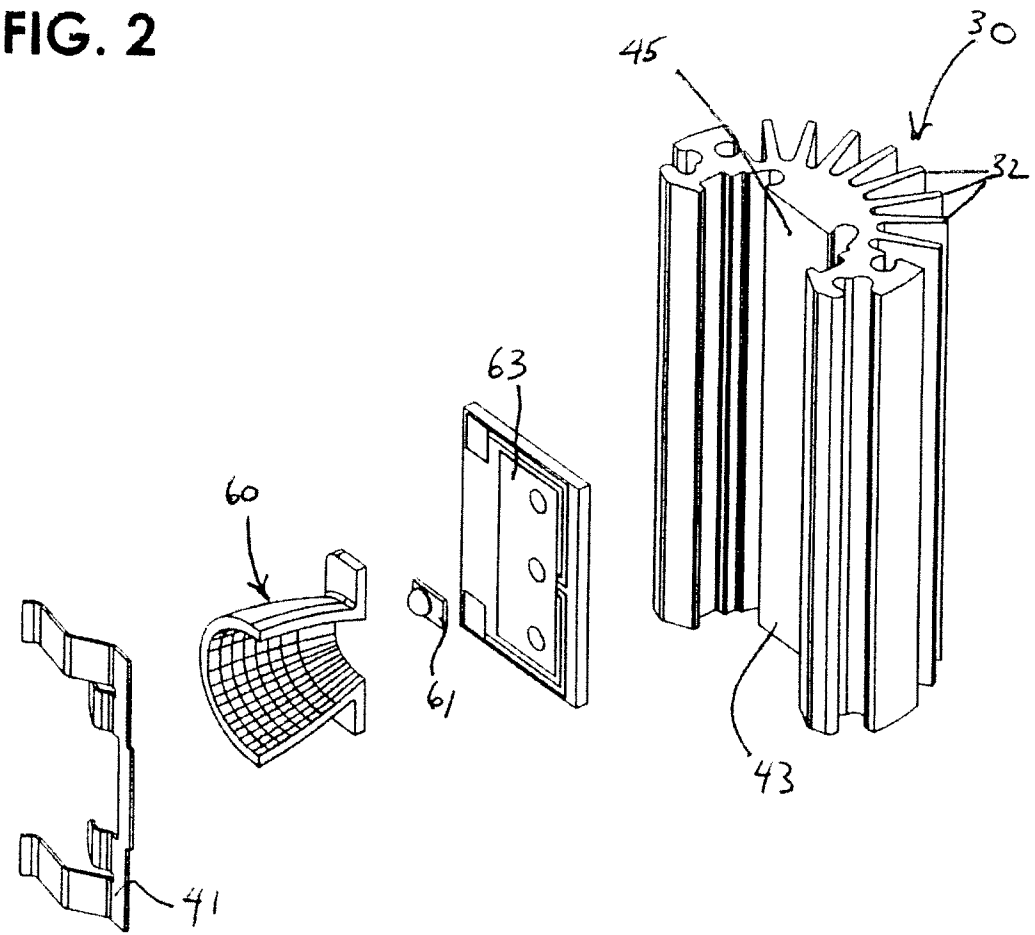
FIG. 2 shows a coined optic in association with a circuit board, a single LED emitter, compression spring and finned heat sink.

Referring to FIG. 2 there is illustrated an additional embodiment of the invention, the coined optic 60 disperses heat that is produced by the emitter on the front side of the circuit board 31. The rear of the circuit board is also in contact with an extruded heat sink 30 and disperses heat to the ambient air. As used herein, the terms "front" and "rear" side of the circuit board are relative terms and do not refer, for example, to the vertical/horizontal orientation of the circuit board. However, when the circuit board is vertically oriented it is possible to use the most effective heat sink orientation. The heat sink 30 can incorporate vertical fins 32 that promote heat dissipation by convection as the heated air rises between with minimum interference by the heat sink structure. However, it has found that the primary improvement in heat dissipation is the use of finned heat sinks over non-finned configurations. Horizontal and inverted horizontal installations still result in adequate heat dissipation for most purposes. Regardless of orientation, the use of finned heat sinks makes it possible to reduce the distance between emitters in a multi-emitter fixture, because little heat is transferred from one emitter to the next. For example, using only the coined fixture and a flat heat sink on the rear of the circuit board may result in the minimum distance between fixtures being 2 inches, where the use of fined heat sinks will permit spacings that are as little as the width of the finned heat sink, or 1 inch for exemplary purposes.

Figure 2A:
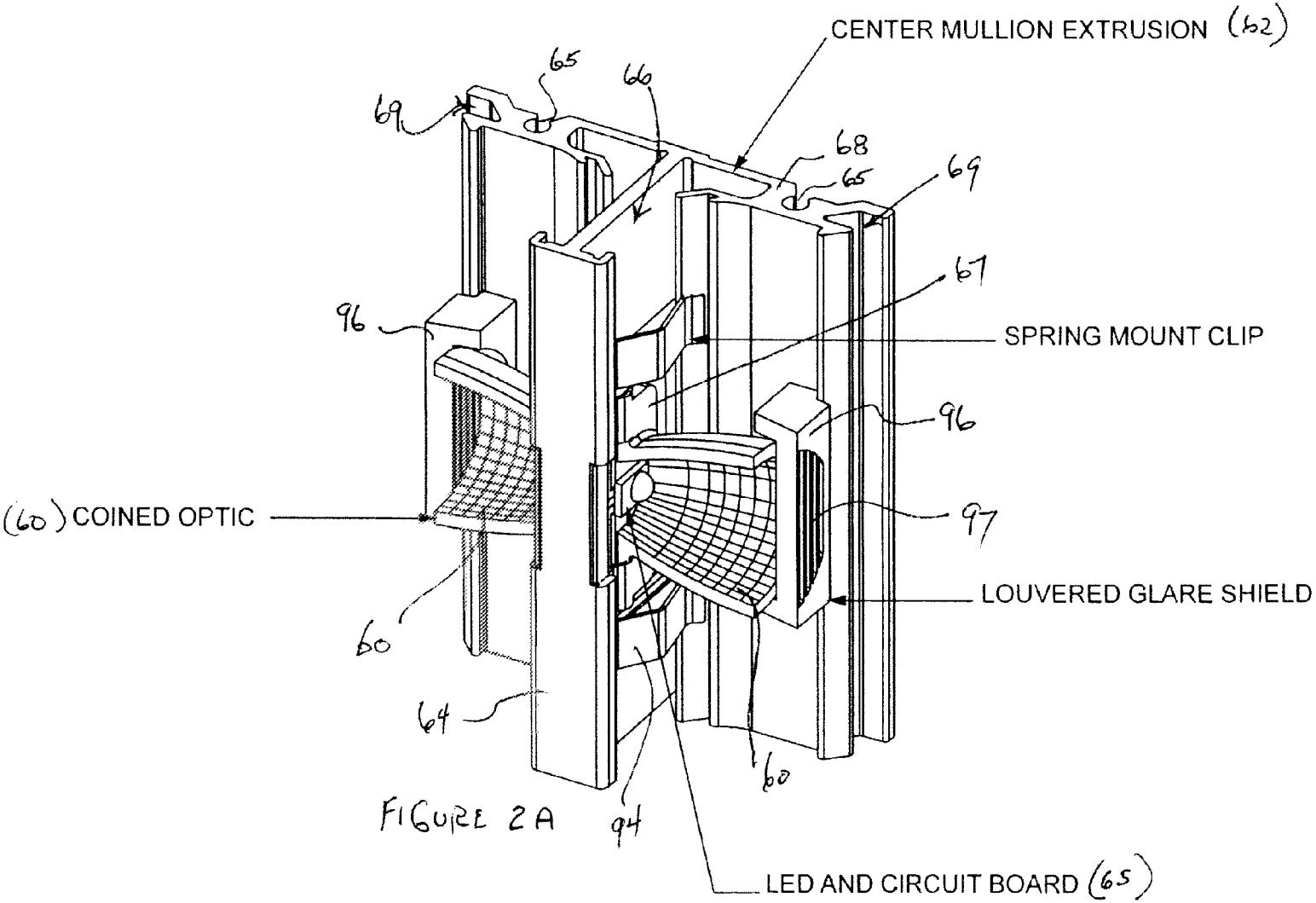
FIG. 2A shows a coined optic mounted on a center mullion extrusion with paired LED emitters in paired optics.

Another embodiment of the invention is made possible by the unique design of the optic is a lighting system that uses only a fraction of the potential circumference of the reflective optic structure. FIG. 2A shows such an embodiment. Two half circular optics 60 are shown to be mounted on the extrusion 62 and specifically on the central mullion 66 which extends at right angles from the base 68 of the extrusion. The circuit board 67 is held in intimate contact with the mullion 66. The optics are positioned by sockets 92 on the circuit board 67. The optics 60 are supported in position by spring clips 94. The fixture may optionally include louvered glare shields 96. The glare shields prevent direct exposure of the light from the emitter to the exterior so that objectionable glare does not exit the fixture. The glare shield incorporates louvers 97 which will pass indirect illumination. Indirect illumination is illumination which is at an angle to the glare shields 96 and therefore able to pass between the louvers 97. The central mullion 66 terminates in a flange 64 which is utilized to provide a broad base of support for a lens (not shown) when it is snapped into position on the mounting groves 69 on the base 68. If the half circumferential optics 60 are directed downwardly such a fixture can be ceiling mounted and deliver approximately 70 to 85 percent of the light produced by the LED's to the illuminated area. This compares with only 30-50 percent of the light emitted by a fluorescent being directed to the illuminated area. The fixture can be mounted on a horizontal surface (such as a ceiling) using groves 65.

Although a single LED is normally associated with each coined optic, multiple emitters can be supported in an array of optics to produce, for example, the lengthwise range of light that normally emanates from a fluorescent tube. See FIGS. 10, 11 and 12. The array 70 will desirably have paired optics 69A with their respective LED's pointing in opposite directions. By pairing the optics economies are realized because of the dual use of the central mount and the dual use of the circuit board heat sink 73. The extended array 70 essentially replicates the features of the dual optic ceiling fixture in FIG. 2A for each pair of optics. At spaced intervals along its length the elongated extrusion 120 has the same features as in FIG. 2A of circuit board mount, contacts and optics mount on the central mullion, and can utilize multiple spring mount clips 94 (see FIG. 2A).

FIGS. 3A through 3F show the procedure followed to illuminate a particular surface. In FIG. 3 the illuminated surface is shown to be rectangular. Next the desired position of the emitter relative to the surface is determined. Horizontal angles necessary to illuminate the target are determined (FIG. 3C) and vertical angles calculated (FIG. 3D). Then the type (linear, parabolic and radius) and orientation of the facets necessary to illuminate the horizontal reach of the illuminated area are calculated (FIG. 3E) and the same calculation made for vertical facets (FIG. 3F). A ray tracing program such as "Trace Pro Expert" (trademark) from Lambdares can facilitate this calculation.

The combination of facets used to produce the best results in regards to light levels and uniformity are subject to the target area needed to be illuminated and the fixture placement in relation to the target area. A radius facet will allow more light to spread in the smallest facet size and is a good choice for creating uniformity. A linear facet is especially useful when a smaller spread of light is needed. Linear facets require a larger facet size to cover a wider spread of light. Parabolic facets are very useful to concentrate light in a more focused area to increase light intensity in an area that would otherwise be noticeably darker. Parabolic facets are used to reach the most furthest distance of the target area. Parabolic facets are especially useful in the portion of the optic nearest the emitter where the light intensity is the highest.

Figure 5:
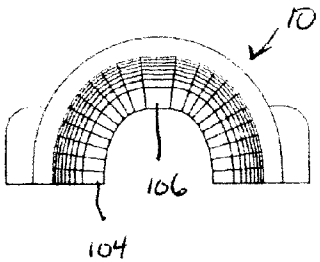
FIG. 5 is an end view of a coined optic which is of a part-circular cross-section and shows the coined inner surface of the optic which arranges the different types of optical surfaces which are arranged in adjacent rows.

FIGS. 4 through 9 show the detail of a half circumferential optic 10 (FIG. 4), with a base 100 and positioning lugs 102. FIG. 5 shows the interior of the optic 10 which has linear facets such as the exemplary facet 104 and parabolic facet 106 on the same row (the innermost row as illustrated). Although it is not always necessary to intermix facets of different types on the same row, the facets are shown intermixed to demonstrate the versatility of the coining process.

Figure 6:
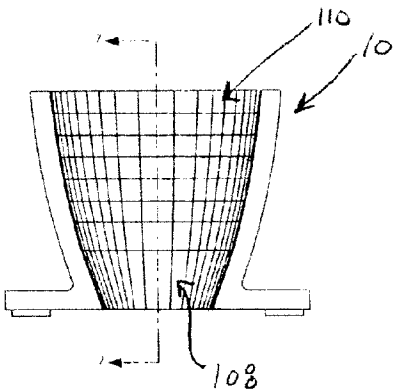
FIG. 6 is an upright view of the coined optic of FIG. 5 showing the flanges which are used to secure the optic in heat conductive relationship with the circuit board that supplies excitation to the LED.

FIG. 6 is a side view of the optic 10 which shows that the facets 108 closest to the emitter can be of the greatest height because they receive and reflect the greatest light flux. They are angulated so that light incident on these facets reflect onto additional facets before exiting the optic. As will appear the other facets such as the outmost facet 110 can be shorter.

Figure 7:
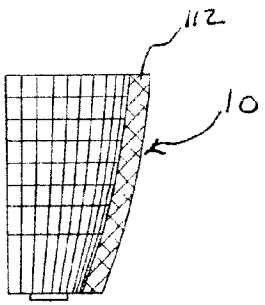
FIG. 7 is an enlarged view of a portion of the optic of FIG. 6, taken on line 7-7 of FIG. 6.
Figure 4:
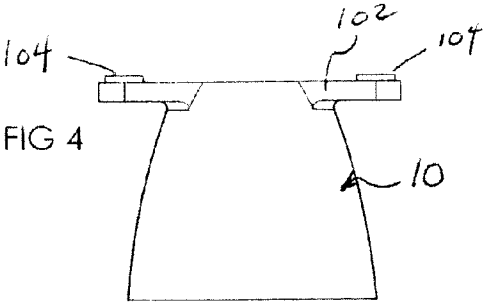
FIG. 4 shows the exterior configuration of a coined optic, such as was represented diagrammatically in FIG. 1.

FIG. 7 shows a section through the half circumferential optic 10, showing the substantial wall thickness 112 which is in part responsible for the stability of the facets after coining.

Figure 8:
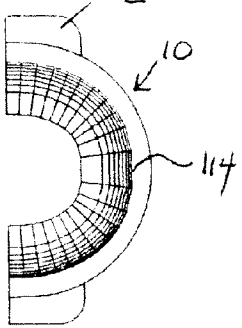
FIG. 8 is a perspective view of the coined optic fixtures 4, 5, 6, and 7.

FIG. 8 is a top view of optic 10, showing the curvature of a representative facet 114 after coining.

Figure 9:
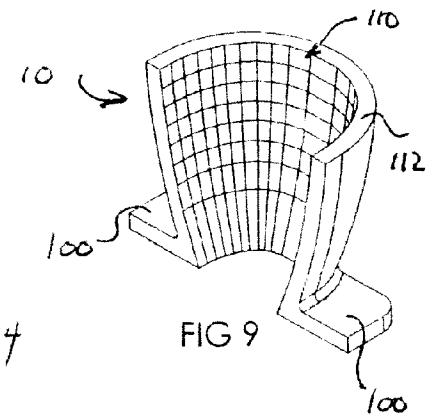
FIG. 9 is an enlarged view of the lower right portion of the fixture of FIG. 7 showing the combination of radiused, parabolic and linear facets on adjacent rows of facets.

FIG. 9 is a perspective view showing all of the features identified in FIGS. 4 through 7 (except for the lugs 102).

Figure 10:
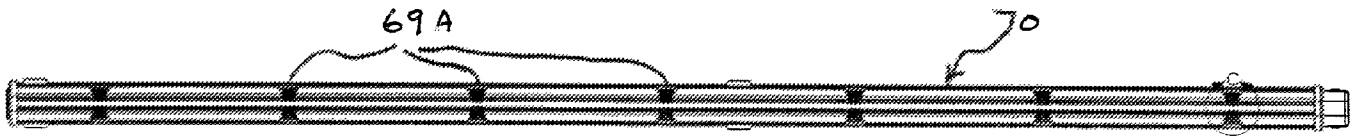
FIG. 10 is a top view of an elongated fixture mount for multiple coined optic fixtures which shows the versatility of the coined optic in meeting virtually any application where a highly controllable illuminated area (shape and controlled illumination intensity).

FIG. 10 shows an elongated fixture. Such a fixture could be used in place of a fluorescent fixture and bulb. The elongated fixture has pair half-circumferential coined optics 130 at intervals along the length of the fixture (only a singe exemplary optic 130 is shown).

Figure 11:
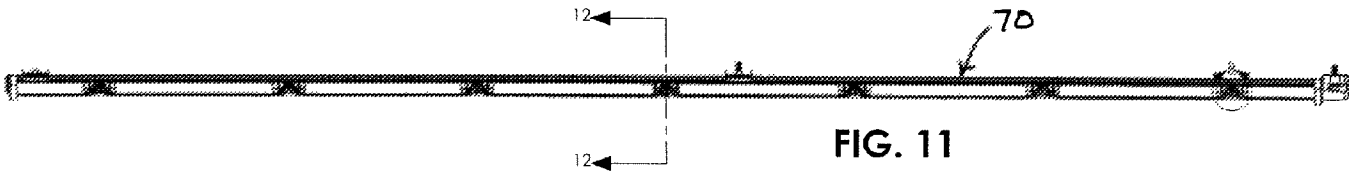
FIG. 11 is a side elevation view of the elongated fixture mount of FIG. 10.

FIG. 11 is a side view of the fixture of FIG. 10.

Figure 12A:
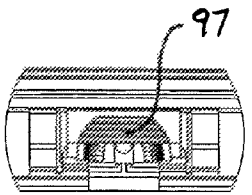
FIG. 12 is a sectional view taken on line 12-12 of FIG. 11 and showing two fixture halves arranged back to back and sharing the same heat sink.
Figure 12B:
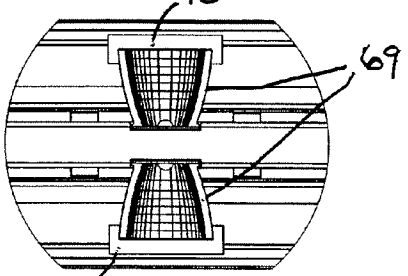
Figure 12:
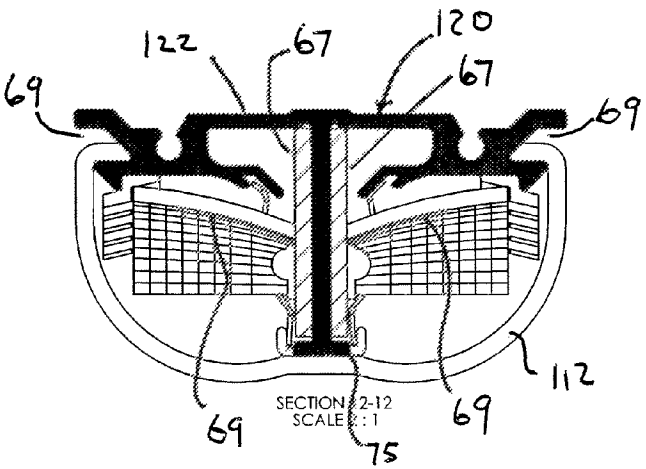

FIG. 12 is cross-sectional view taken on line 12-12 of FIG. 11. The fixture has spaced coined optic mounts such as the exemplary mount 130. The mount utilizes the single extrusion that extends the length of the fixture 70 with a base 120, central mullion 66 which has two spaced mullion pairs with an opening that supports and conducts heat away from a circuit boards 67. The central mullion terminates in a flange 75. Protection for the components and diffusion of the emanated light is provided by a lens 131, which is received against the flange 75 and snaps into the grooves 69 (see FIG. 2A).

Figure 13:
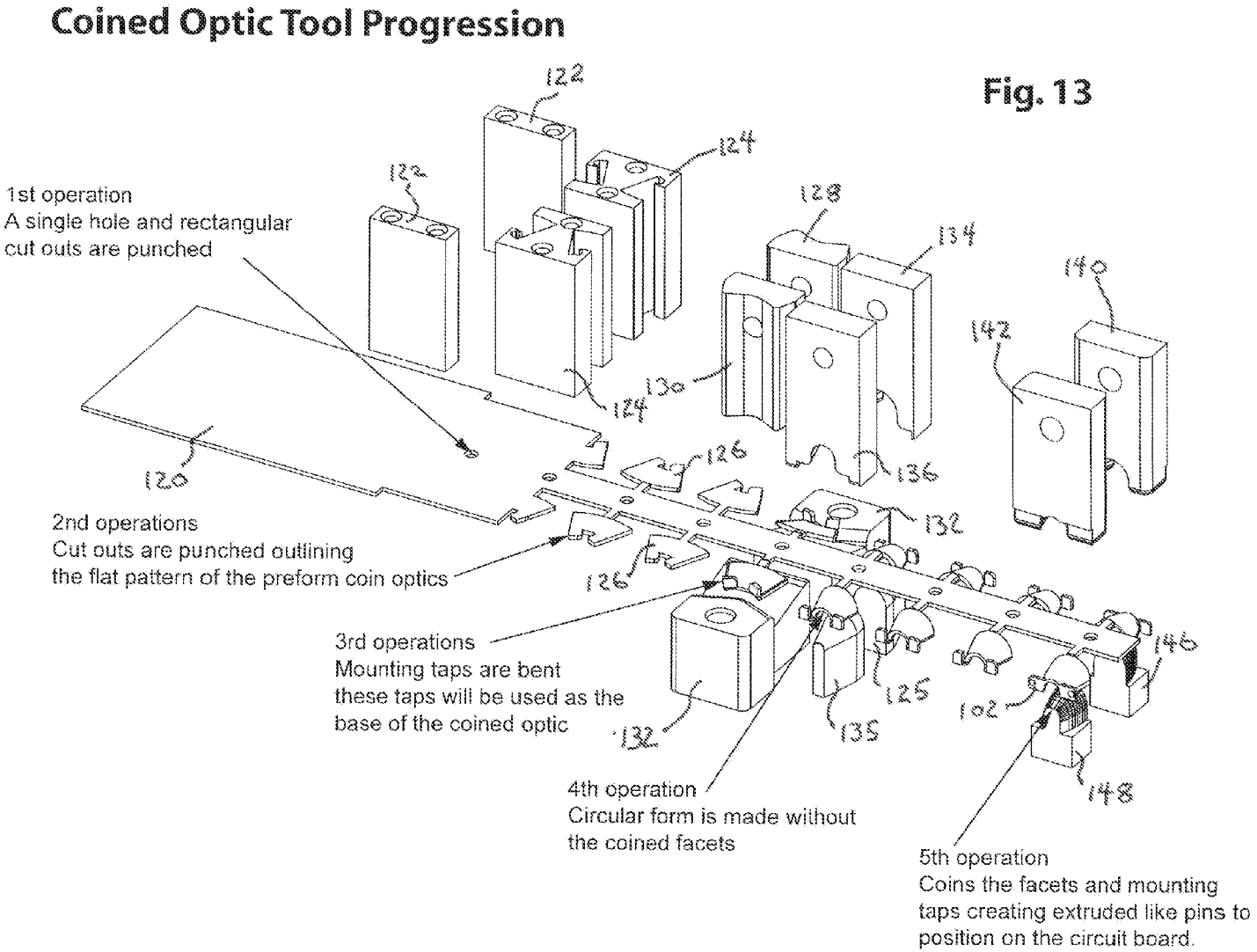
FIG. 13 is a diagrammatic view showing the progression of forming steps to create coined optic halves from flat sheet stock.

FIG. 13 shows how the coining process proceeds from flat stock, through blocking out rectangular cutouts and a drive hole punched to server as a means of driving the strip of metal along to each stamping step. The tools for the rectangular cutouts are shown adjacent the portion of the metal strip when the stamping operation takes place. The tool for creating the hole is not shown but may be made by any conventional means including drilling.

The second set of stamping tools has the shape for forming the flat pattern of the perform optics.

The third set of tools bends up the mounting tabs that will be used for positioning the optic in contact with a circuit board.

The forth set of tools, is utilized to bend the performed optic into the semi-circumferential shape without forming the facets.

The fifth and last forming step is to press the facets into the semi-circumferential preforms. The tools for this purpose are changed depending on the specification for illumination. For example, the tool for use where two semi-circumferential coined optics are used to create the widest spread of light would be changed out to a different tool that might be used to form two identical optics used back-to-back to direct light downward for uniform illumination of a surface below the mounted location.

Having described my invention I now claim:

1. A light fixture for use with near point sources of light comprising:

a near point source of light mounted in a light fixture, the light fixture comprising an optic comprised of malleable metal and with coined reflective facets and wherein the optic has a rear aperture that admits light from at least one near point source of light and has a front aperture that, is open to emit light reflected from one or more of the facets, the optic being comprised of at least one semi-circumferential reflector, the optic having a series of coined facets covering at least a substantial part of the inner surface of the fixture, wherein at least some of the facets are the facet types incorporating linear, and radius shapes.

2. The light fixture of claim 1, wherein:

the near point source of light is a light emitting diode (LED) having a light emitter.

3. The light fixture of claim 1 wherein:

the fixture is comprised of two or more parts that when joined together form a flared hollow shape that incorporates a part circular circumferential cross-section over a substantial portion at the fixtures length, with a diameter of the cross-section that increases with distance from the near point light source.

4. A fixture for use with an optic in association with near point sources of light comprising:

a LED mounted on a circuit board, a reflector mounted adjacent to the LED and in contact with the circuit board, the reflector comprising a malleable high heat conductive material to act as a heat sink and reduce the operating temperature of the LED, the reflector having a plurality of coined reflective facets that are angulated and not perpendicular to light rays emanating from the LED, the angulation of each coined facet being selected to direct light to a surface or virtual surface spaced from the optic and directing the light emanating from the LED to a selected area to be illuminated to a selected level of illumination, the facets being sized to be less than encompassing, the entire reflect surface of the fixture.

5. The light fixture of claim 1, wherein:

the facets are arranged in rows where the facets in the rows are substantially equidistant from the rear aperture of the fixture.

6. A light fixture for use with near point sources of light comprising:

a near point source of light mounted in a light fixture, the light fixture comprising an optic comprised of malleable material with coined reflective facets and wherein the optic has a rear aperture that admits light from at least one near point source of light and a front aperture that, is open to emit light reflected from one or more of the facets, the optic having at least a part circular circumferential cross section over a substantial portion of its length, the optic having a series of facets covering at least a substantial part of the inner surface of the fixture, where at least some of the facets are parabolic in shape.

7. A light fixture for use with near point sources of light comprising:

a near point source of light mounted in a light fixture, the light fixture comprising an optic with reflective facets and wherein the optic has a rear aperture that admits light from at least one near point source of light and a having a front aperture that, is open to emit light reflected from one or more of the facets, the optic being formed of malleable material and having a series of coined facets covering at least a substantial part of the inner surface of the fixture, where at least some of the light from said near point source of light is reflected by two or more facets before the light is emitted from the front aperture of the optic for a wide angle dispersion of emanating from said front aperture.

8. The light fixture of claim 7, wherein:

the near point source of light is a light emitting diode (LED).

9. The light fixture of claim 7, wherein:

the fixture is comprised of two or more parts that when fitted together form a flared hollow shape that incorporates at least a part circular cross-section over a substantial portion of the fixtures depth, with a diameter of the cross-section that increases with distance from the near point source of light.

10. The light fixture of claim 7, wherein:

at least some of the facets are elongated or parabolic in shape.

11. A light fixture for use with near point sources of light comprising:

a near point source of light mounted in a light fixture, the light fixture comprising an optic with reflective coined facets and wherein the optic has a rear aperture that admits light from at least one near point source of light and has a front aperture that is open to emit light reflected from one or more of the facets, the optic being comprised of malleable metal with a series of facets covering at least a substantial part of the inner surface of the fixture and said optic having at least a part circular cross section along at least a portion of its length, at least some of the facets are the facet types including linear and radius facet shapes.

12. The light fixture of claim 11 wherein:

the fixture is comprised of two or more parts that when fitted together form a flared hollow shape that incorporates at least a part circular cross-section over a substantial portion of the fixtures length, with a diameter of the cross-section that increases with distance from the near point light source.

13. The light fixture of claim 11, wherein:

the facets are arranged in rows where the facets in each row are substantially equidistant from the rear aperture of the fixture.

14. A light fixture for use with near point sources of light comprising:

a near point source of light mounted in a light fixture, the light fixture comprising an elongated optic with reflective facets and wherein the optic has a rear aperture that admits light front at least one near point source of light and a having a front aperture that is open to emit light reflected from one or more of the facets, the optic having a series of coined facets covering at least a substantial part of the inner surface of the fixture, where at least some of the facets are formed by cold metal stamping, the fixture is comprised of two or more parts that when fitted together form a flared hollow shape that incorporates at least a part circular cross-section over a substantial portion of the fixtures depth, with a diameter of the cross-section that increases with distance from the near point light source over a substantial portion of said fixtures length.

15. A light fixture for use with near point sources of light comprising:

at least one near point source of light mounted in a light fixture, the light fixture comprising an malleable metal optic with coined reflective facets and wherein the optic has a rear aperture that admits light from at least one near point source of light and has a front aperture that is open to emit light reflected from one or more of the facets, the optic having a series of coined facets covering at least a substantial part of the inner surface of the fixture, where and the facets are arranged in plurality of rows and with a plurality of facets in each row, the facets being arranged to emit light which uniformly illuminates a surface or vituaal surface spaced from the optic.

16. The light fixture of claim 15, wherein:

the at least one near point source of light is a light emitting diode (LED) having a emitter.

17. The light fixture of claim 15, wherein:

the facets are arranged in rows with multiple facets in a row where the facets in the each of multiple rows are substantially equidistant from the rear aperture of the fixture.

18. The light fixture of claim 15, wherein:

at least some of the facets are elongated or parabolic in shape.

* * * * *